US012788067B2

(12) United States Patent
Batista

(10) Patent No.: US 12,788,067 B2
(45) Date of Patent: Nov. 10, 2026

(54) INDUCTIVELY HEATED AEROSOL-GENERATING DEVICE WITH CONSUMABLE EJECTION

(71) Applicant: Philip Morris Products S.A., Neuchatel (CH)

(72) Inventor: Rui Nuno Rodrigues Alves Batista, Neuchâtel (CH)

(73) Assignee: Philip Morris Products S.A., Neuchatel (CH)

( * ) Notice: Subject to any disclaimer, the term of this patent is extended or adjusted under 35 U.S.C. 154(b) by 371 days.

(21) Appl. No.: 18/698,792

(22) PCT Filed: Oct. 17, 2022

(86) PCT No.: PCT/EP2022/078822
§ 371 (c)(1),
(2) Date: Apr. 5, 2024

(87) PCT Pub. No.: WO2023/066862
PCT Pub. Date: Apr. 27, 2023

(65) Prior Publication Data

US 2024/0407448 A1 Dec. 12, 2024

(30) Foreign Application Priority Data

Oct. 18, 2021 (EP) ..... 21203117

(51) Int. Cl.
*A24F 47/00* (2020.01)
*A24F 40/42* (2020.01)
(Continued)

(52) U.S. Cl.
CPC ..... *A24F 40/465* (2020.01); *A24F 40/42* (2020.01); *A24F 40/485* (2020.01)

(58) Field of Classification Search
CPC ..... A24F 40/40; A24F 40/42; A24F 40/465
See application file for complete search history.

(56) References Cited

U.S. PATENT DOCUMENTS

2016/0120221 A1 5/2016 Mironov et al.
2017/0347715 A1 12/2017 Mironov et al.
(Continued)

FOREIGN PATENT DOCUMENTS

RU 2 698 528 C1 8/2019
RU 2 733 817 C2 10/2020
(Continued)

OTHER PUBLICATIONS

Combined Russian Decision to Grant and Search Report issued Feb. 9, 2026 in Russian Patent Application No. 2024113307/03, 9 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating device is provided, including: an induction heater including a first planar susceptor and a second planar susceptor; and a mouthpiece including an extension-and-retraction element, the first and the second planar susceptors being arranged in the mouthpiece, the first planar susceptor being arranged distanced and parallel to the second planar susceptor for holding a planar consumable between the first and the second planar susceptors, and the extension-and-retraction element being configured to at least partly retract the first and the second planar susceptors into the mouthpiece into a retracted position for ejecting the consumable. An aerosol-generating system including the aerosol-generating device according and a consumable including an aerosol-forming substrate is also provided. A method for ejecting a planar consumable from the aerosol-generating system is also provided.

16 Claims, 4 Drawing Sheets

Figure 1:
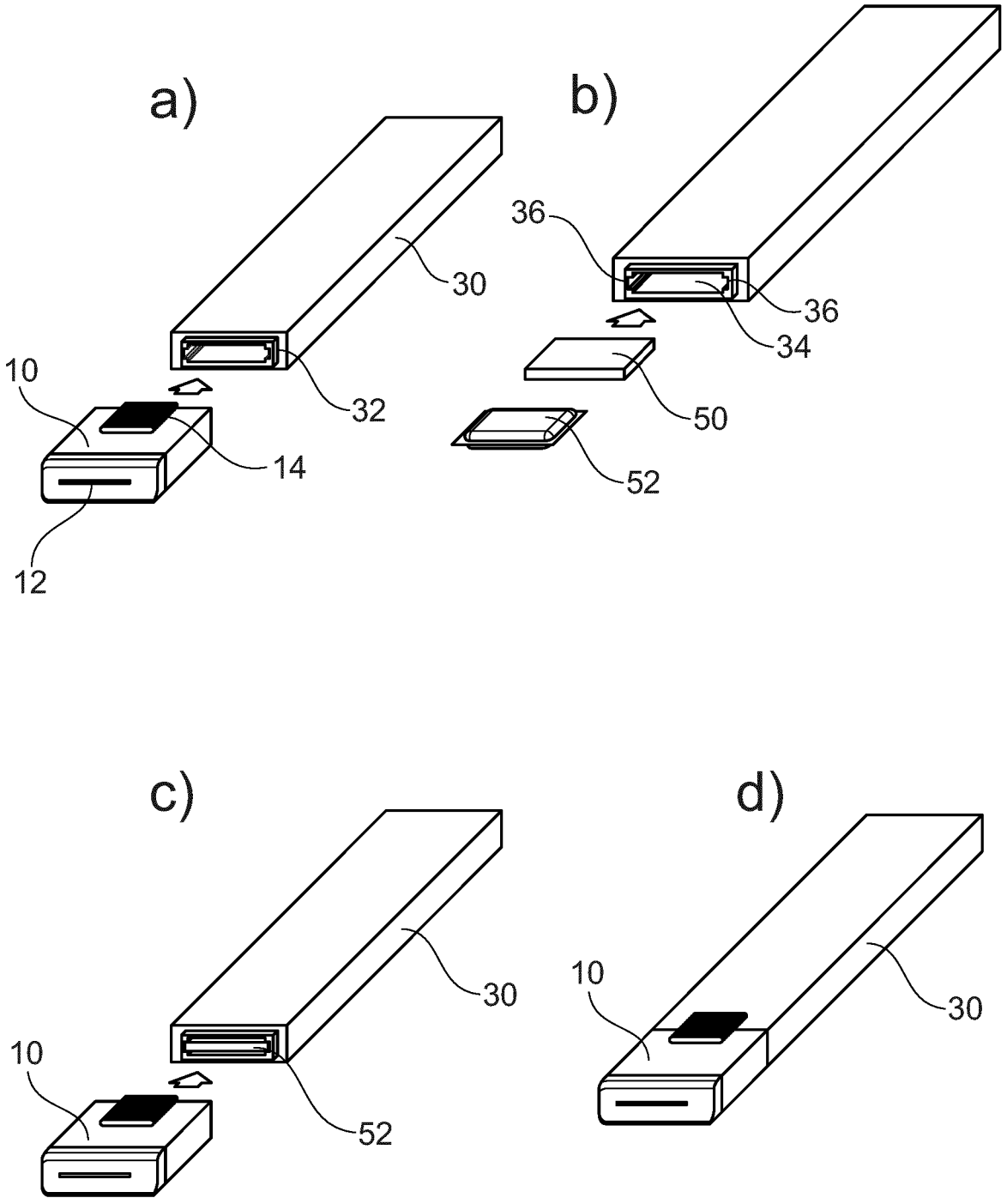

(51) Int. Cl.
*A24F 40/465* (2020.01)
*A24F 40/485* (2020.01)

(56) References Cited

U.S. PATENT DOCUMENTS

| | | | |
|---|---|---|---|
| 2019/0045833 | A1 | 2/2019 | Saygili |
| 2019/0380391 | A1 | 12/2019 | Reevell |
| 2020/0245682 | A1 | 8/2020 | Reevell |
| 2021/0052004 | A1 | 2/2021 | Mironov et al. |
| 2021/0093009 | A1 | 4/2021 | Park et al. |

FOREIGN PATENT DOCUMENTS

| | | | |
|---|---|---|---|
| WO | WO 2015/177046 | A1 | 11/2015 |
| WO | WO 2019/030172 | A1 | 2/2019 |

OTHER PUBLICATIONS

International Search Report issued Dec. 7, 2022 in PCT/EP2022/078822, filed on Oct. 17, 2022, 12 pages.
International Preliminary Report on Patentability and Written Opinion issued Apr. 23, 2024 in PCT/EP2022/078822, 8 pages.
Office Action dated Sep. 28, 2026 issued in corresponding Japanese patent application No. 2024-523202 (with English translation).

a)

b)

INDUCTIVELY HEATED AEROSOL-GENERATING DEVICE WITH CONSUMABLE EJECTION

The present disclosure relates to an aerosol-generating device. The present disclosure further relates to an aerosol-generating system comprising an aerosol-generating device and an aerosol-generating article. The present disclosure further relates to a method for ejecting a planar consumable from an aerosol-generating system.

It is known to provide an aerosol-generating device for generating an inhalable vapor. Such devices may heat an aerosol-forming substrate contained in a cartridge or in an aerosol-generating article without burning the aerosol-forming substrate. The heating arrangement may be an induction heating arrangement and may comprise an induction coil and a susceptor. The susceptor may be part of the device or may be part of the article or cartridge or a mouthpiece.

Upon heating to a target temperature, the aerosol-forming substrate vaporises to form an aerosol. The aerosol-forming substrate may be present in solid form or in liquid form. A solid aerosol-forming substrate may be part of an aerosol-generating article. Removing spent aerosol-forming substrate after use may lead to a user contacting the aerosol-forming substrate. This may be undesired due to hygienic considerations or may be unpleasant for a user. Further, unwanted residues of the spent aerosol-forming substrate may remain in the aerosol-generating device leading to an undesired contamination of the device.

It would be desirable to provide an aerosol-generating device with improved hygiene. It would be desirable to provide an aerosol-generating device with improved handling of spent aerosol-forming substrate for a user. It would be desirable to provide an aerosol-generating device with improved cleaning of the device. It would be desirable to provide an aerosol-generating device which prevents unwanted contamination of the device, particularly with spent aerosol-forming substrates.

According to an embodiment of the invention there is provided an aerosol-generating device. The aerosol-generating device may comprise an induction heater. The induction heater may comprise a first planar susceptor. The induction heater may comprise a second planar susceptor. The aerosol-generating device may comprise a mouthpiece. The mouthpiece may comprise an extension-and-retraction element. The first and second susceptors may be arranged in the mouthpiece. The first susceptor may be arranged distanced and parallel to the second susceptor for holding a planar consumable between the first and second susceptors. The extension-and-retraction element may be configured to at least partly retract the first and second susceptors into the mouthpiece into a retracted position for ejecting the consumable.

According to an embodiment of the invention there is provided an aerosol-generating device. The aerosol-generating device comprises an induction heater. The induction heater comprises a first planar susceptor and a second planar susceptor. The aerosol-generating device comprises a mouthpiece. The mouthpiece comprises an extension-and-retraction element. The first and second susceptors are arranged in the mouthpiece. The first susceptor is arranged distanced and parallel to the second susceptor for holding a planar consumable between the first and second susceptors. The extension-and-retraction element is configured to at least partly retract the first and second susceptors into the mouthpiece into a retracted position for ejecting the consumable.

By means of the aerosol-generating device comprising the extension-and-retraction element, an aerosol-generating device with improved hygiene may be provided. By means of the aerosol-generating device comprising the extension-and-retraction element, an aerosol-generating device with improved handling of spent aerosol-forming substrate for a user may be provided. By means of the aerosol-generating device comprising the extension-and-retraction element, an aerosol-generating device with improved cleaning of the device may be provided. By means of the aerosol-generating device comprising the extension-and-retraction element, an aerosol-generating device which prevents unwanted contamination of the device, particularly with spent aerosol-forming substrates, may be provided.

The aerosol-generating device may further comprise a cavity for receiving the planar consumable comprising an aerosol-forming substrate. The cavity may have a rectangular cross-section. The cavity may be configured as a heating chamber.

The extension-and-retraction element may be configured to at least partly extend the first and second susceptors from the mouthpiece into an extended position for insertion of the first and second susceptors into the cavity of the aerosol-generating device.

The extension-and-retraction element may comprise biasing means for biasing the first and second susceptors towards the extended position.

The extension-and-retraction element may comprise a sliding element. The sliding element may be at least partly arranged on an outer surface of a housing of the aerosol-generating device and configured to be operated by a user. A user may operate the sliding element for repeatedly moving the extension-and-retraction element between the retracted position and the extended position and vice versa.

The aerosol-generating device may comprise a main body. The mouthpiece may comprise means for being releasably attachable to the main body.

The cavity may be comprised in the main body.

The first susceptor may be configured to be arranged adjacent a first lateral sidewall of the cavity. The second susceptor may be configured to be arranged adjacent an opposite second lateral sidewall of the cavity. One or both of the first and second susceptors may comprise a barb at a distal end thereof. The barb may be arranged to point towards an interior space between the first and second susceptors. The barbs may be configured to snip into the consumable when moving the first and second susceptors into the cavity holding the consumable. The barbs may assist in firmly holding the consumable by the first and second susceptors.

The mouthpiece may comprise an air outlet. The mouthpiece may comprise a closing element. The closing element may be configured to close the air outlet when the extension-and-retraction element is arranged in the retracted position.

The mouthpiece may comprise a retaining element. The retaining element may be arranged between the first and second susceptors and configured to block insertion of the consumable held between the first and second susceptors into the mouthpiece during retraction of the first and second susceptors via the extension-and-retraction element.

The invention further relates to an aerosol-generating system comprising the aerosol-generating device as described herein and a consumable as described herein.

The consumable may be planar. The consumable may be a sheet-like consumable. The consumable may be a pouch-like consumable. The consumable may comprise a solid aerosol-forming substrate. The consumable may comprise an aerosol-forming substrate in the form of a gel. The consumable may be a cartridge comprising a liquid aerosol-forming substrate.

The invention further relates to a method for ejecting a planar consumable from an aerosol-generating system as described herein. The method comprises at least partly retracting the extension-and-retraction element into the mouthpiece thereby ejecting the consumable held between the first and second susceptors.

As used herein, the term 'planar' relates to an element having a substantially greater length and width than thickness. The length and width directions are orthogonal to one another and define a first plane. The thickness extends orthogonal to the first plane. A planar element may have two opposing major surfaces extending in plane parallel to the first plane. One or both major surfaces is advantageously flat.

The first susceptor and the second susceptor, together, may form a susceptor assembly. The first planar susceptor and the second planar susceptor may extend parallel to a first plane. The aerosol-generating device may comprise a first inductor coil and a second inductor coil, the first inductor coil positioned on a first side of the first planar susceptor and extending parallel to the first plane, the second inductor coil positioned on a second side of the second planar susceptor opposite the first side and extending parallel to the first plane. The first and second susceptors may be positioned between the first inductor coil and the second inductor coil. The aerosol-generating device may comprise a control circuitry connected to the first and second inductor coils and configured to provide an alternating current to the first and second inductor coils. Advantageously, the first and second susceptors may be substantially equidistant from the first and second inductor coils, respectively.

This arrangement may provide for efficient heating of the first and second susceptors and allows for a balance of forces exerted on the first and second susceptors by the magnetic fields generated by the first and second inductor coils.

In this context a planar susceptor is a susceptor element having a substantially greater length and width than thickness. The length and width directions are orthogonal to one another and define the first plane. The thickness extends orthogonal to the first plane. A planar susceptor may have two opposing major surfaces extending in plane parallel to the first plane. One or both major surfaces is advantageously flat.

In this context, the susceptor assembly being substantially equidistant form the first and second inductor coils means that the shortest distance between the first inductor coil and the first susceptor is between 0.8 and 1.2 times the shortest distance between the second inductor coil and the second susceptor. Even more preferably, the shortest distance between the first inductor coil and the first susceptor is substantially identical to the shortest distance between the second inductor coil and the second susceptor.

Advantageously, the first and second inductor coils are planar inductor coils. In this context a planar inductor coil means a coil that lies in a plane normal to the axis of winding of the coil. Planar inductor coils may be compact. The planar inductor coils may each lie in a plane parallel to the first plane.

The aerosol-generating device may be configured so that the at least one inductor coil provides a magnetic field at the susceptor assembly that is normal to the first plane. The system may be configured so that the first and second inductor coils provide a magnetic field at the susceptor assembly that is normal to the first plane. This allows for efficient heating of the susceptor element. It has also been found by the inventors that such an arrangement promotes efficient heating of the first and second susceptor elements such that lower frequencies of alternating of current can be used. For example, an alternating current having a frequency of between 100 KHz and 1 MHz may be used. Lower frequencies may allow for simpler electronics to be used to supply the alternating current.

The first and second planar inductor coils may have any shape, but in one advantageous embodiment each of the planar inductor coils is rectangular. The planar inductor coils may advantageously have a size and shape corresponding to a heating area of the susceptor element. The first inductor coil may have the same number of turns as the second inductor coil. The first inductor coil may have the same size and shape as the second inductor coil. The first inductor coil may be substantially identical to the second inductor coil. The first inductor coil may have an identical electrical resistance to the second inductor coil. The first inductor coil may have an identical inductance to the second inductor coil.

In one embodiment, the inductor coils are electrically connected to form a single conductive path, and the first inductor coil is wound in an opposite sense to the second inductor coil. The first and second inductor coils may then be provided with an identical alternating electrical current.

In another embodiment, the first inductor coil is wound in the same sense to the second inductor coil. The control circuitry may be configured to provide current to the first inductor coil that is directly out of phase with the current provided to the second inductor coil.

The aerosol-generating device may comprise one or more flux concentrators configured to contain a magnetic field generated by the inductor coils. The one or more flux concentrators may be configured to concentrate the magnetic field on the susceptor assembly, preferably perpendicular to the first plane.

As used herein, the term 'aerosol-forming substrate' relates to a substrate capable of releasing volatile compounds that can form an aerosol or a vapor. Such volatile compounds may be released by heating the aerosol-forming substrate. The aerosol-forming substrate may be in solid form or may be in liquid form. The terms 'aerosol' and 'vapor' are used synonymously.

The aerosol-forming substrate may be part of the consumable. The aerosol-forming substrate may be a solid aerosol-forming substrate. The aerosol-forming substrate may be part of a liquid held in a liquid storage portion of the consumable. The liquid storage portion may contain a liquid aerosol-forming substrate. Alternatively or in addition, the liquid storage portion may contain a solid aerosol-forming substrate. For example, the liquid storage portion may contain a suspension of a solid aerosol-forming substrate and a liquid. Preferably, the liquid storage portion contains a liquid aerosol-forming substrate.

The aerosol-forming substrate may comprise nicotine. The nicotine-containing aerosol-forming substrate may be a nicotine salt matrix.

The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1, 3-butanediol. Preferably, the aerosol former is glycerine. Where present, the homogenised tobacco material may have an aerosol-former content of equal to or greater than 5 percent by weight on a dry weight basis, and preferably from 5 percent to 30 percent by weight on a dry weight basis. The aerosol-forming substrate may comprise other additives and ingredients, such as flavourants.

As used herein, the term 'consumable' refers to an article comprising an aerosol-forming substrate that is capable of releasing volatile compounds that can form an aerosol. For example, a consumable may be an article that generates an aerosol that is directly inhalable by the user drawing or puffing on a mouthpiece at a proximal or user-end of the aerosol generating device. A consumable may be disposable. The consumable may be insertable into the heating chamber of the aerosol-generating device.

As used herein, the term 'liquid storage portion' refers to a storage portion comprising an aerosol-forming substrate that is capable of releasing volatile compounds that can form an aerosol. The liquid storage portion may be configured as a container or a reservoir for storing the liquid aerosol-forming substrate.

The liquid storage portion may be configured as a replaceable tank or container. The liquid storage portion may be any suitable shape and size. For example, the liquid storage portion may be substantially cylindrical. The cross-section of the liquid storage portion may, for example, be substantially circular, elliptical, square or rectangular.

As used herein, the term 'aerosol-generating device' refers to a device that interacts with a consumable to generate an aerosol.

As used herein, the term 'aerosol-generating system' refers to the combination of an aerosol-generating device with a consumable. In the system, the aerosol-generating device and the consumable cooperate to generate a respirable aerosol.

Preferably, the aerosol-generating device is portable. The aerosol-generating device may have a size comparable to a conventional cigar or cigarette. The device may be an electrically operated smoking device. The device may be a handheld aerosol-generating device. The aerosol-generating device may have a total length between 30 millimetres and 150 millimetres. The aerosol-generating device may have an external diameter between 5 millimetres and 30 millimetres.

The aerosol-generating device may comprise a housing. The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise at least one air inlet. The housing may comprise more than one air inlet.

The aerosol-generating device may comprise a heating element. The heating element may comprise at least one inductor coil for inductively heating one or more susceptors.

Operation of the heating element may be triggered by a puff detection system. Alternatively, the heating element may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button. The sensor may also be configured as a pressure sensor.

The aerosol-generating device may include a user interface to activate the aerosol-generating device, for example a button to initiate heating of the aerosol-generating device or a display to indicate a state of the aerosol-generating device or of the aerosol-forming substrate.

The aerosol-generating device may include additional components, such as, for example a charging unit for recharging an on-board electric power supply in an electrically operated or electric aerosol-generating device.

As used herein, the term 'proximal' refers to a user-end, or mouth-end of the aerosol-generating device or system or a part or portion thereof, and the term 'distal' refers to the end opposite to the proximal end. When referring to the heating chamber, the term 'proximal' refers to the region closest to the open end of the cavity and the term 'distal' refers to the region closest to the closed end.

As used herein, the terms 'upstream' and 'downstream' are used to describe the relative positions of components, or portions of components, of the aerosol-generating device in relation to the direction in which a user draws on the aerosol-generating device during use thereof.

The term 'airflow path' as used herein denotes a channel suitable to transport gaseous media. An airflow path may be used to transport ambient air. An airflow path may be used to transport an aerosol. An airflow path may be used to transport a mixture of air and aerosol.

As used herein, a 'susceptor' or 'susceptor element' means an element that heats up when subjected to an alternating magnetic field. This may be the result of eddy currents induced in the susceptor element, hysteresis losses, or both eddy currents and hysteresis losses. During use, the susceptor element is located in thermal contact or close thermal proximity with an aerosol-forming substrate received in the aerosol-generating device. In this manner, the aerosol-forming substrate is heated by the susceptor such that an aerosol is formed.

The susceptor material may be any material that can be inductively heated to a temperature sufficient to aerosolize an aerosol-forming substrate. Suitable materials for the susceptor material include graphite, molybdenum, silicon carbide, stainless steels, niobium, aluminium, nickel, nickel containing compounds, titanium, and composites of metallic materials. Preferred susceptor materials comprise a metal or carbon. Advantageously the susceptor material may comprise or consists of a ferromagnetic or ferri-magnetic material, for example, ferritic iron, a ferromagnetic alloy, such as ferromagnetic steel or stainless steel, ferromagnetic particles, and ferrite. A suitable susceptor material may be, or comprise, aluminium. The susceptor material may comprise more than 5 percent, preferably more than 20 percent, more preferably more than 50 percent, or more than 90 percent of ferromagnetic, ferri-magnetic or paramagnetic materials. Preferred susceptor materials may be heated to a temperature in excess of 250 degrees Celsius without degradation.

The susceptor material may be formed from a single material layer. The single material layer may be a steel layer.

The susceptor material may comprise a non-metallic core with a metal layer disposed on the non-metallic core. For example, the susceptor material may comprise metallic tracks formed on an outer surface of a ceramic core or substrate.

The susceptor material may be formed from a layer of austenitic steel. One or more layers of stainless steel may be arranged on the layer of austenitic steel. For example, the susceptor material may be formed from a layer of austenitic steel having a layer of stainless steel on each of its upper and lower surfaces. The susceptor element may comprise a single susceptor material. The susceptor element may comprise a first susceptor material and a second susceptor material. The first susceptor material may be disposed in intimate physical contact with the second susceptor material. The first and second susceptor materials may be in intimate contact to form a unitary susceptor. In certain embodiments, the first susceptor material is stainless steel and the second susceptor material is nickel. The susceptor element may have a two-layer construction. The susceptor element may be formed from a stainless steel layer and a nickel layer.

Intimate contact between the first susceptor material and the second susceptor material may be made by any suitable means. For example, the second susceptor material may be plated, deposited, coated, clad or welded onto the first susceptor material. Preferred methods include electroplating, galvanic plating and cladding.

The aerosol-generating device may a power supply for powering the heating element. The power supply may comprise a battery. The power supply may be a lithium-ion battery. Alternatively, the power supply may be a nickel-metal hydride battery, a nickel cadmium battery, or a lithium-based battery, for example a lithium-cobalt, a lithium-iron-phosphate, lithium titanate or a lithium-polymer battery. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

The power supply may be a direct current (DC) power supply. In one embodiment, the power supply is a DC power supply having a DC supply voltage in the range of 2.5 Volts to 4.5 Volts and a DC supply current in the range of 1 Amp to 10 Amps (corresponding to a DC power supply in the range of 2.5 Watts to 45 Watts). The aerosol-generating device may advantageously comprise a direct current to alternating current (DC/AC) inverter for converting a DC current supplied by the DC power supply to an alternating current. The DC/AC converter may comprise a Class-D, Class-C or Class-E power amplifier. The AC power output of the DC/AC converter is supplied to the induction coil.

The power supply may be adapted to power an inductor coil and may be configured to operate at high frequency. A Class-E power amplifier is preferable for operating at high frequency. As used herein, the term 'high frequency oscillating current' means an oscillating current having a frequency of between 500 kilohertz and 30 megahertz. The high frequency oscillating current may have a frequency of from 1 megahertz to 30 megahertz, preferably from 1 megahertz to 10 megahertz, and more preferably from 5 megahertz to 8 megahertz.

In another embodiment the switching frequency of the power amplifier may be in the lower kHz range, e.g. between 100 kHz and 400 KHz. In the embodiments, where a Class-D or Class-C power amplifier is used, switching frequencies in the lower kHz range are particularly advantageous.

The aerosol-generating device may comprise a controller. The controller may be electrically connected to the inductor coil. The controller may be electrically connected to the first induction coil and to the second induction coil. The controller may be configured to control the electrical current supplied to the induction coil(s), and thus the magnetic field strength generated by the induction coil(s).

The power supply and the controller may be connected to the inductor coil(s).

The controller may be configured to be able to chop the current supply on the input side of the DC/AC converter. This way the power supplied to the inductor coil(s) may be controlled by conventional methods of duty-cycle management.

Features described in relation to one embodiment may equally be applied to other embodiments of the invention.

Figure 3:
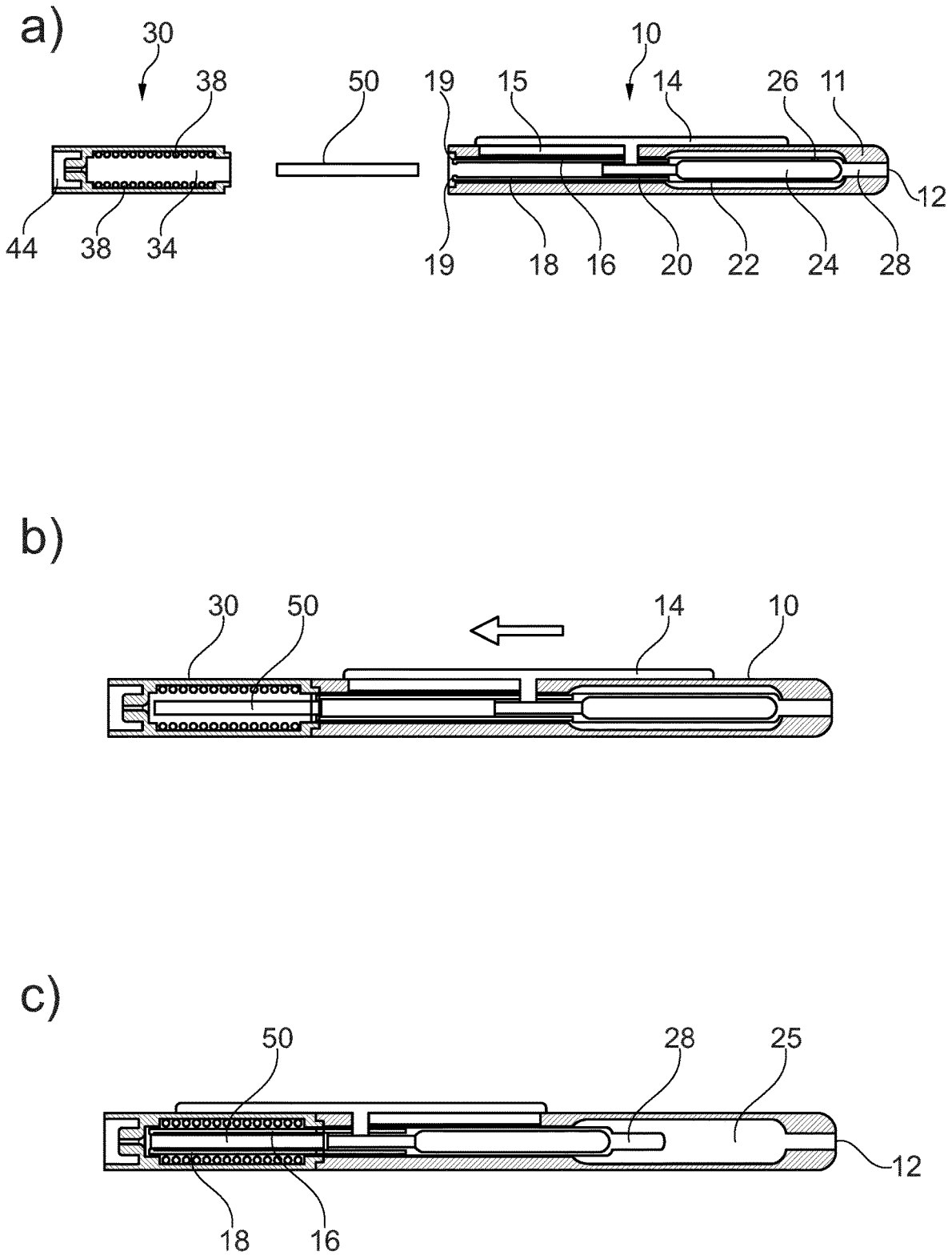
Figure 4:
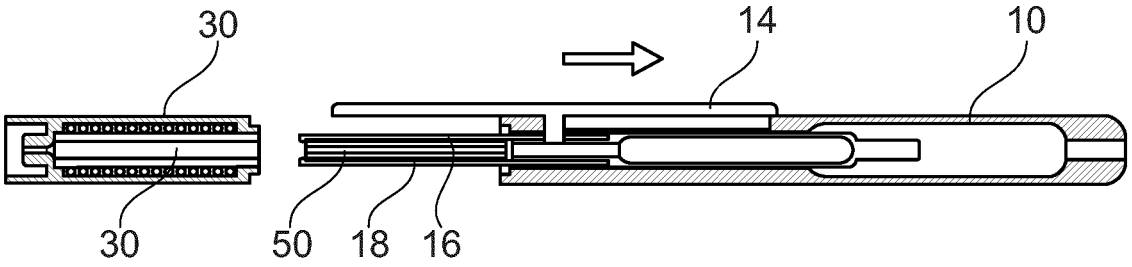
Figure 4:
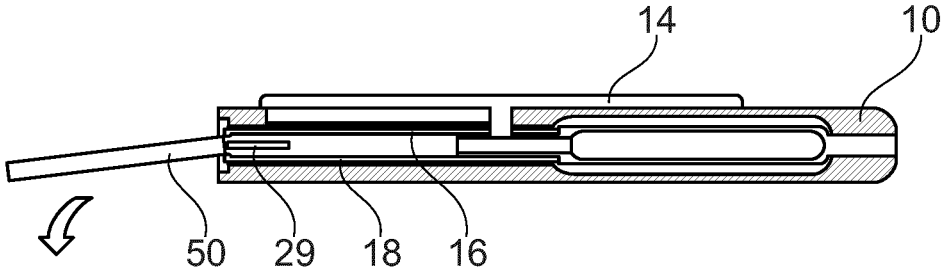

The invention will be further described, by way of example only, with reference to the accompanying drawings in which:

FIGS. 1*a* to 1*d* show insertion of a consumable into an aerosol-generating device;

FIGS. 2*a* to 2*d* show extraction of a consumable from an aerosol-generating device;

FIGS. 3*a* to 3*c* show insertion of a consumable into an aerosol-generating device; and FIGS. 4*a* and 4*b* show extraction of a consumable from an aerosol-generating device.

FIGS. 1*a* to 1*d* show stepwise insertion of a fresh consumable into an aerosol-generating device in perspective views.

FIG. 1*a* shows a mouthpiece 10 of the aerosol-generating device and a main body 30 of the aerosol-generating device in a detached configuration. The mouthpiece 10 is releasably attachable to the main body 30. An arrow indicates the direction of attaching the mouthpiece 10 from the main body 12. In the attached configuration, a firm attachment may be achieved by a form fit between a protruding structure 32 of the main body 30 and a corresponding recess (not shown) of the mouthpiece 10.

The mouthpiece 10 comprises an air outlet 12 for an aerosol to exit the device. The mouthpiece 10 comprises a sliding element 14 arranged on an outer surface of the mouthpiece 10 and configured to be operated by a user. The sliding element 14 is part of the extension-and-retraction element which will be explained further below.

FIG. 1*b* shows a step of insertion of a fresh planar consumable into a heating chamber 34 of the main body 30. The heating chamber 34 has a rectangular cross-section. Slits 36 allow to hold an inserted planar consumable within the heating chamber 34 in a centered position. This may ensure that there is an empty space in the heating chamber 34 above and below the centered consumable allowing smooth insertion of planar susceptors into said empty space.

The planar consumable may be a sheet-like consumable 50 or a pouch-like consumable 52. An arrow indicates the direction of inserting the consumable, for example the sheet-like consumable 50, into the heating chamber 34.

FIG. 1*c* shows a step of attaching the mouthpiece 10 to the main body 30 after the consumable, for example the sheet-like consumable 50, has been inserted. An arrow indicates the direction of attaching the mouthpiece 10 to the main body 30.

FIG. 1*d* shows the aerosol-generating device in a ready-to-use configuration with the mouthpiece 10 being attached to the main body 30.

FIGS. 2*a* to 2*d* show stepwise extraction of a spent consumable from the aerosol-generating device in perspective views.

FIG. 2*a* shows the aerosol-generating device after use with the mouthpiece 10 still being attached to the main body 30.

FIG. 2*b* shows the aerosol-generating device after use, with the mouthpiece 10 being detached from the main body 30. An arrow indicates the direction of detaching the mouthpiece 10 from the main body 30. The planar consumable, for example the sheet-like consumable 50, is sandwiched between a first planar susceptor 16 of the mouthpiece 10, and a second planar susceptor (not shown) of the mouthpiece 10. Thereby, the consumable will be automatically withdrawn from the heating chamber 34 when the mouthpiece 10 being detached from the main body 30.

FIG. 2*c* shows the mouthpiece 10 in the configuration of FIG. 2*b* rotated by 180 degrees. It can now be seen that the sheet-like consumable 50 is held between the first planar susceptor 16 and a second planar susceptor 18 arranged distanced and parallel to the first susceptor 16. An arrow indicates the direction a user may move the sliding element 14 in order to retract the first and second susceptors 16, 18 into the mouthpiece 10 into a retracted position for ejecting the consumable.

The mouthpiece 10 in retracted position is shown in FIG. 2*d*, i.e. after having moved the sliding element 14 into the retracted position as indicated by the arrow in FIG. 2*c*. The sliding element 14 is part of the extension-and-retraction element of the mouthpiece 10. By retracting the sliding element 14, the first and second susceptors 16,18 are at least partly retracted into the mouthpiece 10 into the retracted position for ejecting the consumable as shown in FIG. 2*d*. Thereby, the consumable, for example the sheet-like consumable 50, is ejected. Thereby, the consumable will fall out of the mouthpiece 10, without direct manipulation by the user.

In FIG. 2*d*, also optional retaining elements 29 of the mouthpiece 10 are visible. The retaining elements 29 are configured as protrusions arranged between the first and second susceptors 16, 18 and configured to block insertion of the consumable held between the first and second susceptors into the mouthpiece 10 during retraction of the first and second susceptors 16, 18 via the extension-and-retraction element.

FIGS. 3*a* to 3*c* show stepwise insertion of a fresh consumable into an aerosol-generating device in cross-sectional views.

Figure 2:
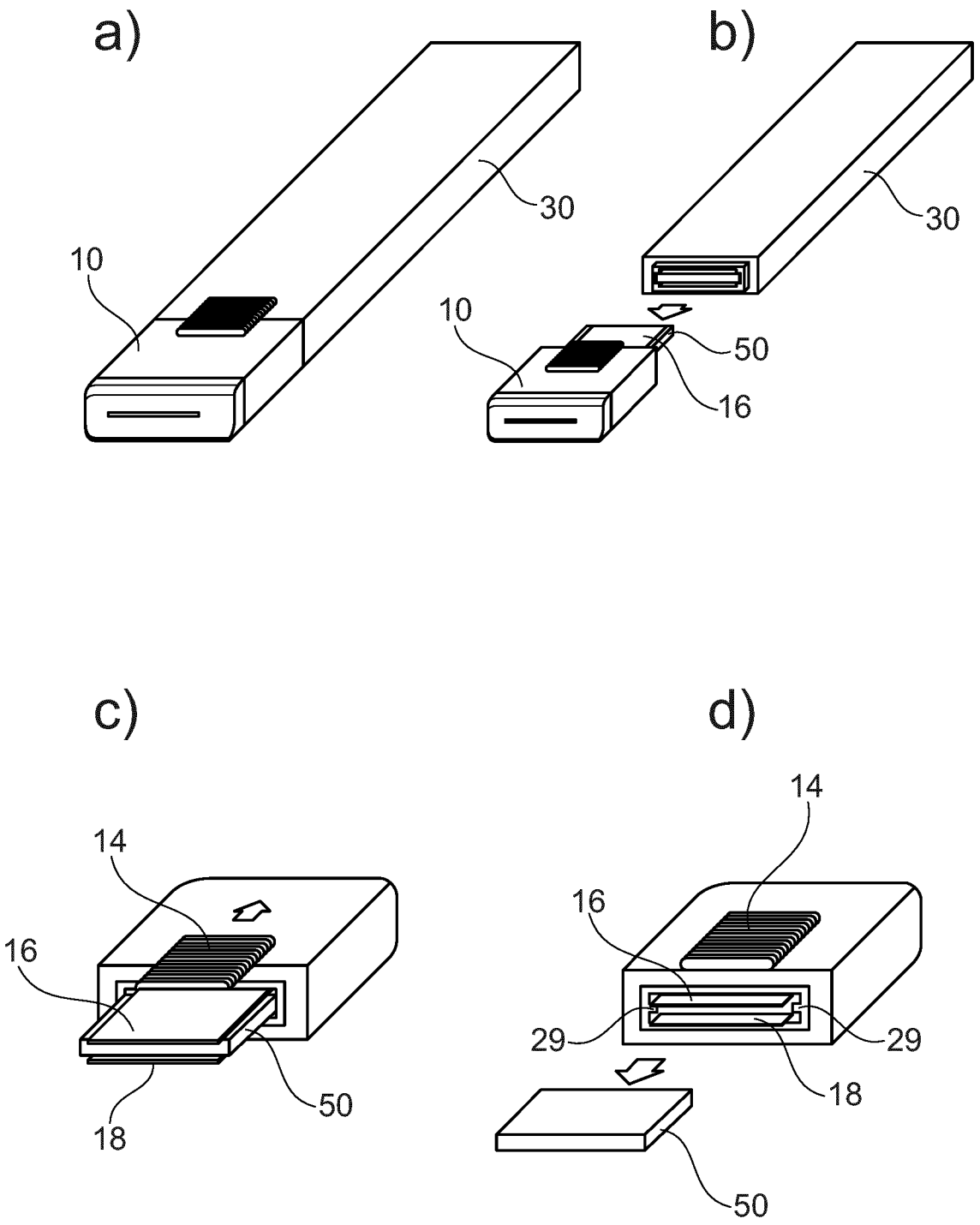

FIG. 3*a* shows a mouthpiece 10, a sheet-like consumable 50, and a proximal portion of a main body 30 in a detached configuration in cross-sectional view. The shown proximal portion of the main body 30 comprises the heating chamber 34 as well as a pair of inductor coils 38 sandwiching the heating chamber 34. A distal portion of the main body (not shown) comprising electronic compounds like a battery and a controller, may be configured as a separate element releasably attachable via a connecting portion 44. Alternatively, the main body 30 may be provided as an integral unit as shown in FIGS. 1 and 2.

The mouthpiece 10 comprises an extension-and-retraction element which is repeatedly movable with respect to a mouthpiece housing 11 from an extended position into a retracted position and vice versa. In FIG. 3*a*, the extension-and-retraction element is shown in its retracted position. The extension-and-retraction element comprises a sliding element 14 for a user to move the extension-and-retraction element in a horizontal direction. Proximal and distal ends of a sliding recess 15 limit the extend of the horizontal movability of the extension-and-retraction element. The extension-and-retraction element further comprises first and second susceptors 16, 18.

The first susceptor 16 is configured to be arranged adjacent a first lateral sidewall of the heating chamber 34. The second susceptor is configured to be arranged adjacent an opposite second lateral sidewall of the heating chamber 34. The first and second susceptors 16, 18 may each comprise a barb 19 provided at a distal end thereof and pointing towards the interior space between the first and second susceptors 16, 18. The barbs 19 may snip into the consumable when moving the extension-and-retraction element into the extended position as shown in FIG. 3*c*. The barbs 19 may assist in holding the consumable.

The extension-and-retraction element further comprises a hollow conducting member 20 horizontally movable within the mouthpiece housing 11. The first and second susceptors 16, 18 are fixed to the hollow conducting member 20. A hollow inner core of the conducting member 20 forms a portion of an airflow path downstream of the consumable 50. The conducting member 20 merges into a hollow chamber member 22 at a proximal end thereof. The chamber member 22 circumscribes a first aerosol-management chamber 24 located downstream of the conducting member 20. The chamber member 22 comprises apertures 26 for the airflow to exit the first aerosol-management chamber 24. The chamber member 22 merges into a closing element 28 at a proximal end thereof. In the retracted position shown in FIG. 3*a*, the air outlet 12 is closed by the closing element 28. Thereby, the mouthpiece 10 can be in a self-locking position when not in use. Interior parts of the mouthpiece 10 can thereby be protected from e.g., saliva or dust.

FIG. 3*b* shows a next step, where the sheet-like consumable 50 has been inserted into the heating chamber 34, and the mouthpiece 10 has been attached to the main body 30. In FIG. 3*b*, the extension-and-retraction element of the mouthpiece 10 is still in the retracted position. An arrow indicates the direction of moving the extension-and-retraction element from the retracted position into the extended position which is shown in FIG. 3*c*. This may be accomplished by a user moving the sliding element 14.

FIG. 3*c* shows the extension-and-retraction element being in the extended position after the extension-and-retraction element having been moved from the retracted position into the extended position. FIG. 3*c* shows a ready-to-use configuration. The first and second susceptors 16, 18 have been moved into the heating chamber 43 such that they hold the planar consumable 50 between the first and second susceptors 16, 18. The chamber member 22 has been moved such that a second aerosol-management chamber 25 has been formed. The closing element 28 has been moved away from the air outlet 12 which is thus no longer closed by the closing element 28.

The airflow path extends from an air inlet (not shown) in the main body through the heating chamber 43 housing the consumable. During use, an alternating current is applied to the inductor coils 38 which creates an alternating magnetic field. The alternating magnetic field, in turn, induces currents within the first and second susceptors 16, 18 that cause the first and second susceptors 16, 18 to heat up. The consumable located in the heating chamber 43 is heated by thermal transfer from the first and second susceptors 16, 18 to the consumable. Evaporated compounds produced from a heated aerosol-forming substrate of the heated consumable may be taken up by the airflow. The airflow further passes via the hollow inner core of the conducting member 20 into the first aerosol-management chamber 24 and then via apertures 26 into the second aerosol-management chamber 25. The first and second aerosol-management chambers may be designed, for example as condensation and/or cooling chambers such that a desired composition, temperature, etc. of the aerosol may evolve. Finally, the aerosol exits the air outlet 12 where it may be inhaled by a user.

FIGS. 4*a* and 4*b* show stepwise extraction of a spent consumable from the aerosol-generating device in cross-sectional views.

In the configuration shown in FIG. 4*a*, the mouthpiece 10 has already been detached from the main body 30. Notably, the extension-and-retraction element still remains in the extended position. Thereby, the planar consumable, for example the sheet-like consumable 50 is held between the first and second susceptors 16, 18 and thereby extracted from the heating chamber 43 when the mouthpiece 10 is being detached from the main body 30. The consumable may thus be extracted from the heating chamber 43 without the need for a user to directly contact the consumable.

An arrow in FIG. 4*a* indicates the direction of moving the extension-and-retraction element from the extended position into the retracted position which is shown in FIG. 4*b*. This may be accomplished by a user moving the sliding element 14.

FIG. 4*b* shows a final step, where the extension-and-retraction element of the mouthpiece 10 has been moved into the retracted position. Thus, the first and second susceptors 16, 18 have been moved back into the mouthpiece 10. Consequently, the sheet-like consumable 50 is no longer sandwiched and held between the first and second susceptors 16, 18 and will be discarded by the force of gravity. A user may, for example, operate the sliding element 14 to move the extension-and-retraction element into the retracted position after having located the mouthpiece 10 above a suitable trash can. Thereby, a user may conveniently discard a spent consumable in a hygienic manner.

In FIG. 4*b*, also an optional retaining element 29 of the mouthpiece 10 is shown. The retaining element 29 may, for example, be configured as a pin or protrusion mounted on an inner side of the mouthpiece housing circumscribing the extension-and-retraction element. The retaining element 29 is arranged between the first and second susceptors 16, 18 and configured to block insertion of the consumable held between the first and second susceptors into the mouthpiece 10 during retraction of the first and second susceptors 16, 18 via the extension-and-retraction element. The retaining element 29 is further configured in size and shape such that it does not block the airflow path and such that it does not hinder movement of the extension-and-retraction element between the extended and retracted positions.

The invention claimed is:

1. An aerosol-generating device, comprising:

an induction heater comprising a first planar susceptor and a second planar susceptor; and a mouthpiece comprising an extension-and-retraction element, wherein the first and the second planar susceptors are arranged in the mouthpiece, wherein the first planar susceptor is arranged distanced and parallel to the second planar susceptor for holding a planar consumable between the first and the second planar susceptors, and wherein the extension-and-retraction element is configured to at least partly retract the first and the second planar susceptors into the mouthpiece into a retracted position for ejecting the consumable.

2. The aerosol-generating device according to claim 1, further comprising a cavity configured to receive the planar consumable comprising an aerosol-forming substrate.

3. The aerosol-generating device according to claim 2, wherein the cavity is configured as a heating chamber.

4. The aerosol-generating device according to claim 2, wherein the cavity has a rectangular cross-section.

5. The aerosol-generating device according to claim 2, wherein the extension-and-retraction element is further configured to at least partly extend the first and the second planar susceptors from the mouthpiece into an extended position for insertion of the first and the second planar susceptors into the cavity of the aerosol-generating device.

6. The aerosol-generating device according to claim 5, wherein the extension-and-retraction element comprises biasing means for biasing the first and the second planar susceptors towards the extended position.

7. The aerosol-generating device according to claim 1, wherein the extension-and-retraction element comprises a sliding element, and wherein the sliding element is at least partly arranged on an outer surface of a housing of the aerosol-generating device and configured to be operated by a user.

8. The aerosol-generating device according to claim 1, further comprising a main body, wherein the mouthpiece further comprises means for being releasably attached to the main body.

9. The aerosol-generating device according to claim 2, wherein the cavity is comprised in the main body.

10. The aerosol-generating device according to claim 2, wherein the first planar susceptor is configured to be arranged adjacent a first lateral sidewall of the cavity, and wherein the second planar susceptor is configured to be arranged adjacent an opposite second lateral sidewall of the cavity.

11. The aerosol-generating device according to claim 1, wherein the mouthpiece further comprises an air outlet and a closing element, and wherein the air outlet is closed when the extension-and-retraction element is arranged in the retracted position.

12. The aerosol-generating device according to claim 1, wherein the mouthpiece further comprises a retaining element, and wherein the retaining element is arranged between the first and the second planar susceptors and configured to block insertion of the consumable held between the first and the second planar susceptors into the mouthpiece during retraction of the first and the second planar susceptors via the extension-and-retraction element.

13. An aerosol-generating system comprising the aerosol-generating device according to claim 1 and a consumable comprising an aerosol-forming substrate.

14. The aerosol-generating system according to claim 13, wherein the consumable is planar.

15. The aerosol-generating system according to claim 13, wherein the consumable is a pouch-like consumable.

16. A method for ejecting a planar consumable from an aerosol-generating system according to claim 13, the method comprising at least partly retracting the extension-and-retraction element into the mouthpiece thereby ejecting the consumable held between the first and the second planar susceptors.

* * * * *